US005685219A

United States Patent [19]

Schwelling

[11] Patent Number: 5,685,219

[45] Date of Patent: Nov. 11, 1997

[54] SAFETY FRONT DOOR FOR BALING PRESSES

[76] Inventor: Hermann Schwelling, Hartmannweg 5, 88682 Salem, Germany

[21] Appl. No.: 576,803

[22] Filed: Dec. 21, 1995

[30] Foreign Application Priority Data

Dec. 27, 1994 [DE] Germany ..... 44 46 459.2

[51] Int. Cl.[6] ..... B30B 9/30

[52] U.S. Cl. ..... 100/53; 100/255

[58] Field of Search ..... 100/53, 245, 255

[56] References Cited

U.S. PATENT DOCUMENTS

| | | | |
|---|---|---|---|
| 1,112,723 | 10/1914 | Schick | 100/255 |
| 1,196,126 | 8/1916 | Lundahl | 100/255 |
| 4,041,857 | 8/1977 | Weeks | 100/255 |
| 4,512,252 | 4/1985 | Goldhammer | 100/255 |

FOREIGN PATENT DOCUMENTS

| | | | |
|---|---|---|---|
| 17328 | 7/1913 | United Kingdom | 100/255 |

*Primary Examiner*—Stephen F. Gerrity
*Attorney, Agent, or Firm*—Friedrich Kueffner

[57] ABSTRACT

A safety front door for a baling press having a vertically acting pressure ram for producing tied bales of old cardboard, foils and other used packaging material, wherein the door area for the filling shaft of the press is constructed as a flap which can be opened by manually swinging it about a horizontal axis into an essentially horizontal position. In the horizontal plane, the flap is divided by an additional hinge and, in the final opening position of the flap, the forward free flap portion extends in an approximately vertical direction relative to the press bottom portion. The upper side of the frame of the front door and the door sliding angle attached to the housing are located approximately by a hand's width above the upper side of the pressure ram plate when the pressure ram is in its uppermost end position. In addition to hinges, the two portions of the filling shaft flap are connected to the front door frame through gas springs or similar braking elements, so that the forward free flap portion is swung down into the vertical position only after the entire flap has reached the horizontal position.

2 Claims, 4 Drawing Sheets

SAFETY FRONT DOOR FOR BALING PRESSES

BACKGROUND OF THE INVENTION

1. Field of the Invention

The present invention relates to a safety front door for a baling press having a vertically acting pressure ram for producing tied bales of old cardboard, foils and other used packaging material.

2. Description of the Related Art

A known safety door of this type includes a circumferentially extending outer hollow section frame which can be swung downwardly together with the door panel through hinges with vertical axis for the purpose of removing finished bales from the press housing. Since the finished bale must be tied before it is removed from the press and before the pressure ram can be moved into its upper dead center position, there is the danger in the previously known press constructions that, when one of the operators of the press does not pay attention, a possibly present second person standing in front of the open pressing shaft may suffer injuries to the hands or arms when they rest because of inattention on the upper side of the pressure ram and the upwardly moving ram reaches the area of the uppermost door sliding angle at the press housing as its end point.

Another danger in the previously known press constructions of this type is the fact that the front door panels in the area of the filling shaft are generally constructed as flaps which are to be opened manually and mechanically about a horizontally extending axis, wherein the flap extends essentially horizontally away from the press housing in the open state of the flap. This results in the disadvantage that, when waste materials are to be filled into the filling shaft, the outwardly projecting flap prevents the operator from moving close enough to the inlet opening to achieve an optimum filling capacity for each stroke of the pressure ram. Changing the construction of the door in such a way that the door can be swung out about a vertical axis is also not an option because even less waste material can be forced into the shaft of the press when closing this type of door.

In contrast to the presses used in actual practice, DE 31 12 914 A1 describes a door for a filling shaft which is divided by a horizontal hinge. However, this reference does not disclose any structural and functional features as to how this door could be constructed in an operationally safe manner.

SUMMARY OF THE INVENTION

Therefore, it is the primary object of the present invention to provide a safety front door of the above-described type in which the operational advantages of the known doors are maintained, while the door does not pose any dangers to the operator of the press when the door is open as well as during the opening process of the filling shaft flaps.

In accordance with the present invention, the door area for the filling shaft of the press is constructed as a flap which can be opened by manually swinging it about a horizontal axis into an essentially horizontal position. In the horizontal plane, the flap is divided by an additional hinge and, in the final opening position of the flap, the forward free flap portion extends in an approximately vertical direction relative to the press bottom portion. The upper side of the frame of the front door and the door sliding angle attached to the housing are located approximately by a hand's width above the upper side of the pressure ram plate when the pressure ram is in its uppermost end position. In addition to hinges, the two portions of the filling shaft flap are connected to the front door frame through gas springs or similar braking elements, so that the forward free flap portion is swung down into the vertical position only after the entire flap has reached the horizontal position.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
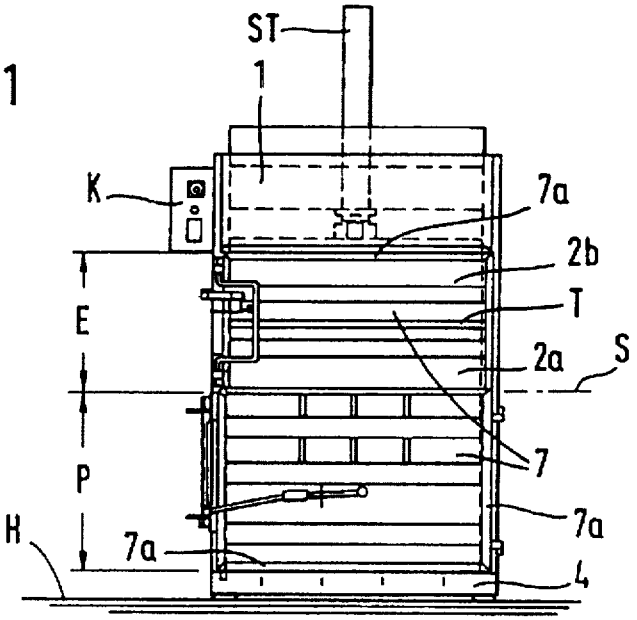
FIG. 1 is a front view of a press with a vertically acting pressure ram.

The baling press schematically illustrated in a front view in FIG. 1 includes a press housing 1 and a vertical pressure ram drive ST and a control panel K. The press housing 1 rests with its bottom portion U on a foundation H. In the areas of a filling shaft E and a pressing shaft P, the press housing 1 is closed by doors 2*a*, 2*b* and 7.

The door for the filling shaft is composed of a flap 2*a*, 2*b* which can be swung open about a horizontally extending axis S. The flap is divided into flap portions 2*a*, 2*b* by another hinge G extending along a separating joint T in a horizontal plane. As a result, the forward, free flap portion 2*b* can be folded down further into the vertical position illustrated in FIG. 7.

Figure 7:
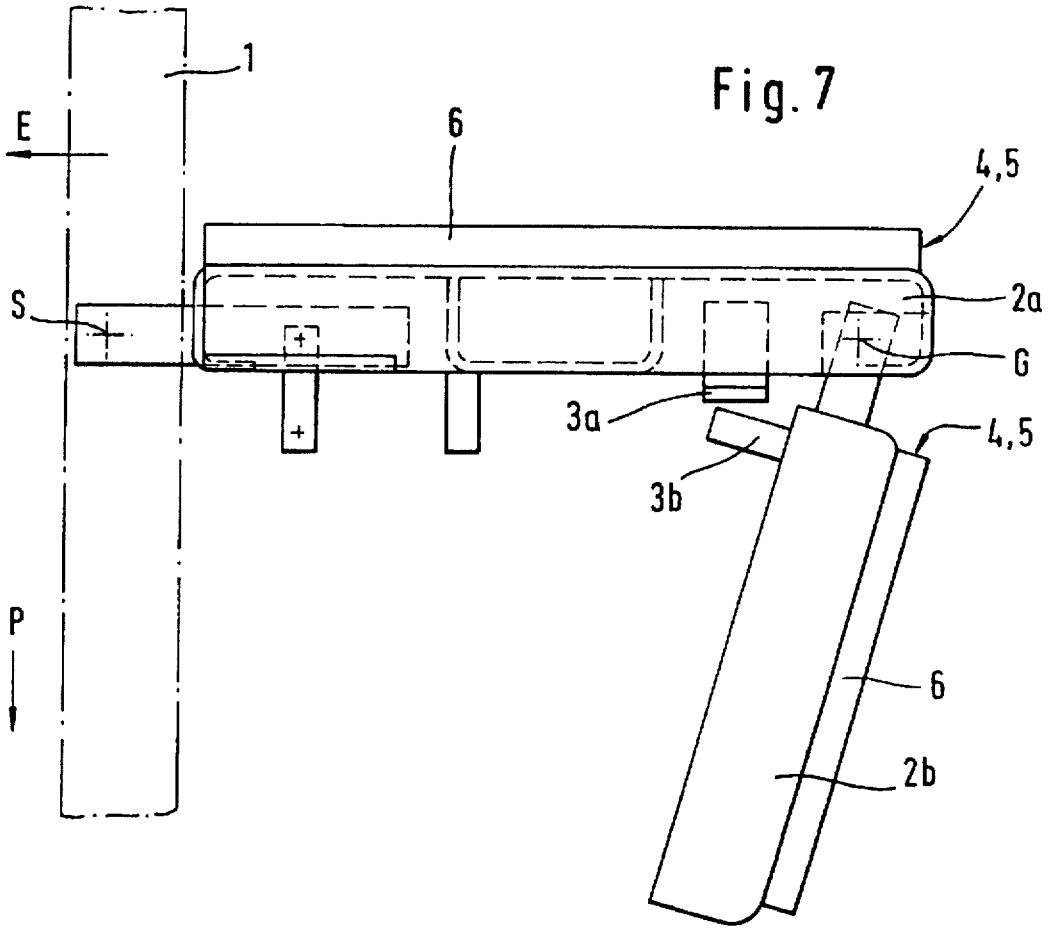
FIG. 7 is the same view as FIG. 6, showing the flap in the open position.

For meeting the object of the present invention of an operation of this flap which is operationally safe and secure against accidents, the two flap portions 2*a* and 2*b*, in addition to the joints G and S, are connected to the press housing 1 through gas springs or similar braking elements, so that the forward free flap portion 2*b* can be swung downwardly into the vertical position shown in FIG. 7 only after the entire flap 2*a*, 2*b* has reached the horizontal position; accordingly, the forward flap portion 2*b* can never fall down in an uncontrolled manner and endanger the operator of the press.

In accordance with another feature important for the operation of the press, a limiting stop 3*a* and 3*b* is provided for limiting the downward swinging movement of the forward free flap portion 2*b* relative to the lower flap portion 2*a* attached to the housing 1; this prevents, for example, uncontrolled swinging movements of the free flap portion 2*b* relative to the flap portion 2*a*.

Finally, for an exact alignment of the two flap portions 2*a* and 2*b* in the closed position of the filling shaft door, adjustable stops 4, 5 are provided in the area of the separating joint T between the two flap portions 2*a* and 2*b* at the free ends of the distance ledges 6 mounted on the inner side of the door.

With respect to an advantageous operation of the press, it has been found useful if both flap portions 2*a* and 2*b* have essentially the same size and the lower portion 2*a* directly attached to the press housing 1 is slightly lower than the free portion 2*b*.

Figures 2, 3, 4:
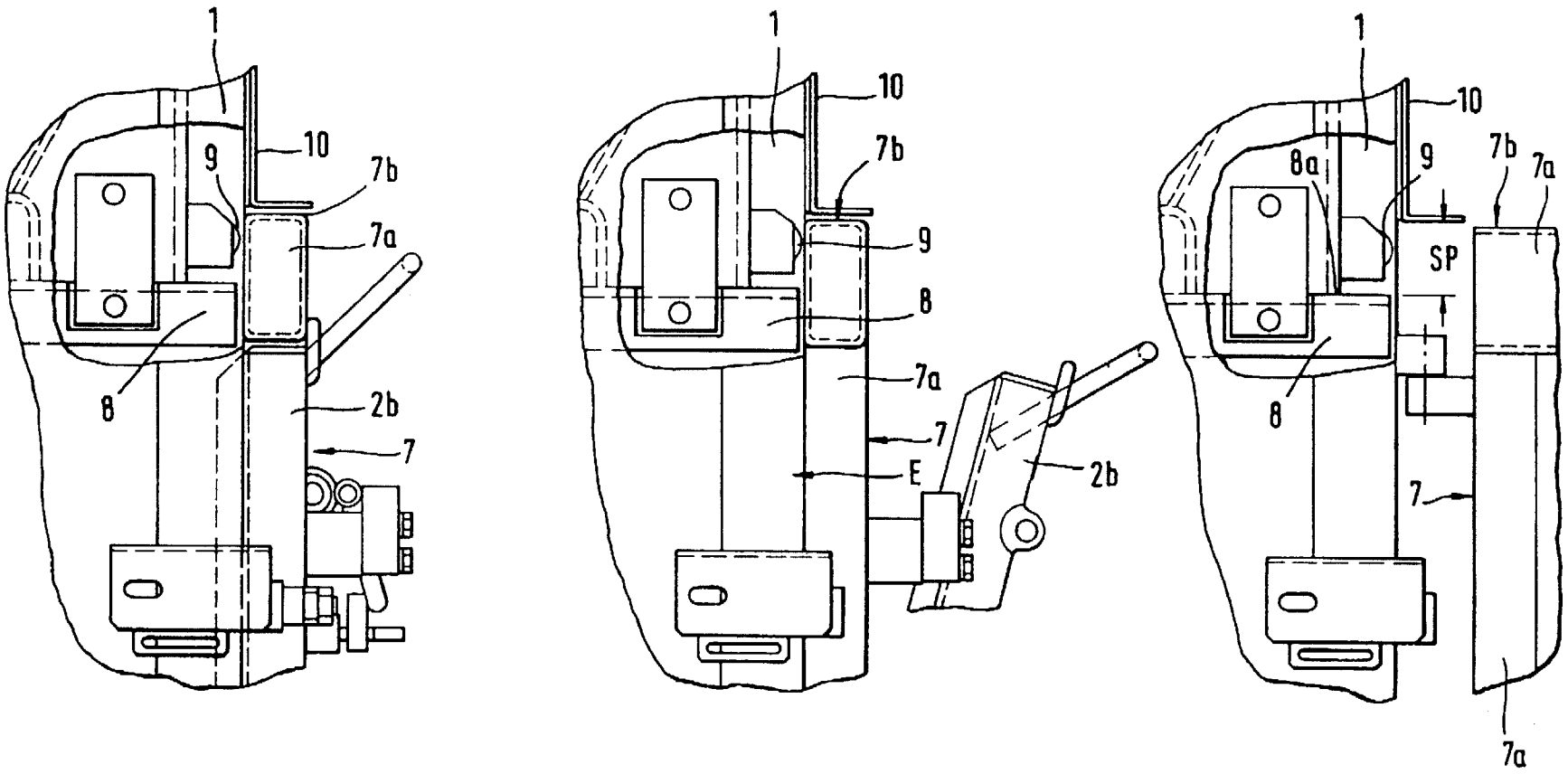
FIG. 2 is a partial sectional side view, on a larger scale, showing the upper door area with the door in the closed position.
FIG. 3 is a view similar to FIG. 1, showing the filling flap in the open position.
FIG. 4 is a view similar to FIG. 2, showing the bale removal door in open position.
Figure 5:
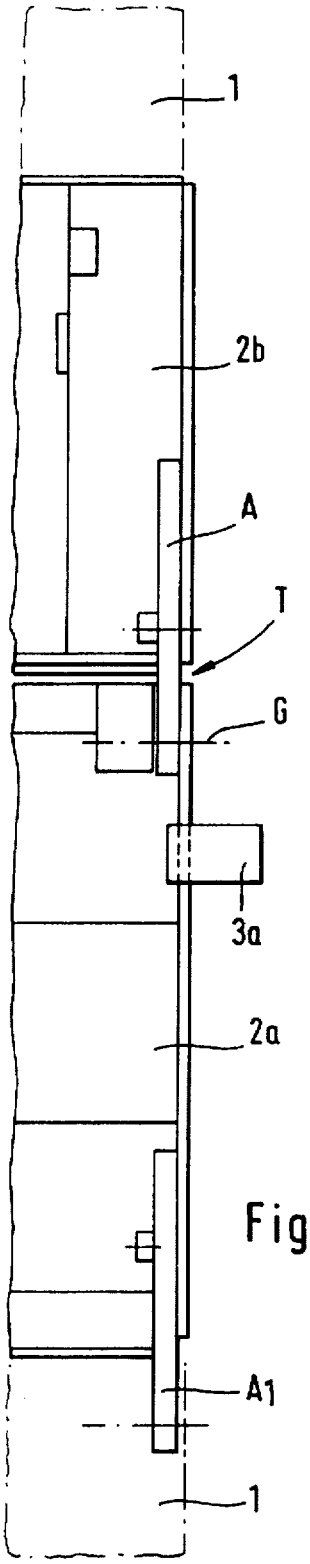
FIG. 5 is a partial front view, also on a larger scale, showing the filling flap according to the present invention.
Figure 6:
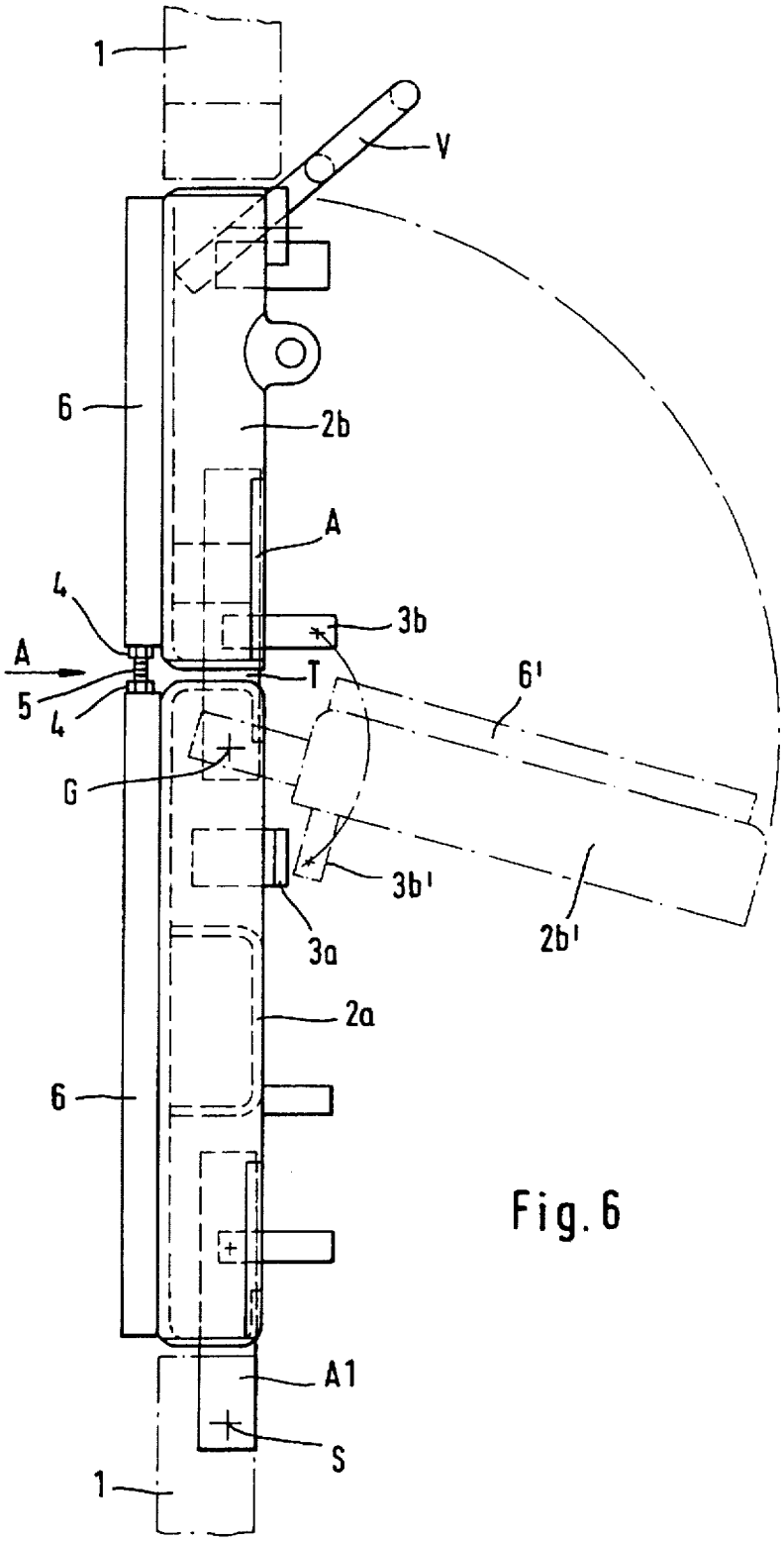
FIG. 6 is a side view of the filling flap of FIG. 5, shown in the closed position.
Figure 8:
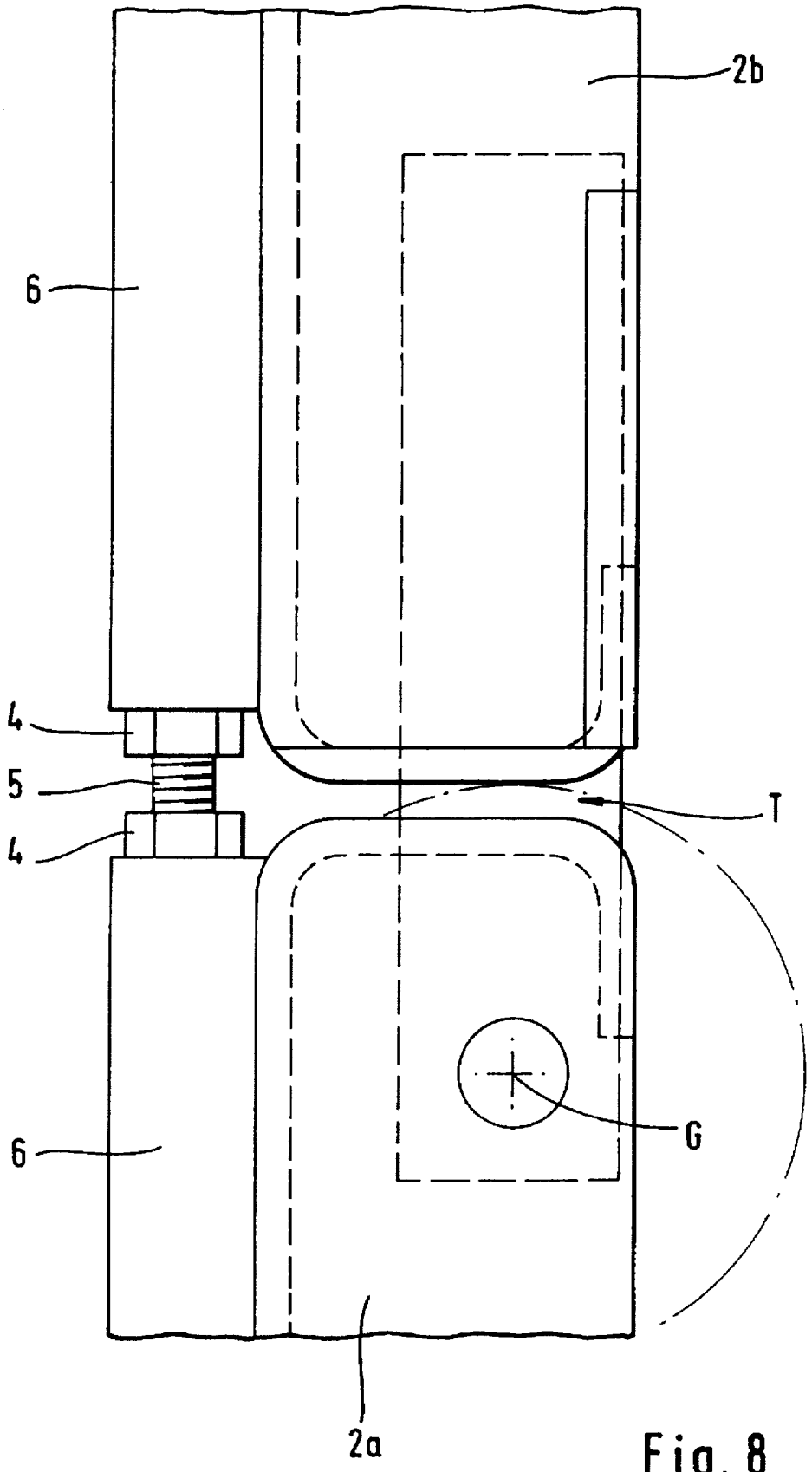
FIG. 8 is a partial view, on an even larger scale, showing a detail in the direction of arrow A of FIG. 6.

The novel features according to the present invention with respect to the overall front door 7 are, as shown in FIGS. 2–4, that the upper side 7*b* of the frame 7*a* of the front door 7 and the door sliding angle 10 which is part of the housing are arranged approximately a hand's width SP above the upper side 8*a* of the pressure ram plate 8 in the highest end position thereof. In accordance with another structural feature, the door frame 7*a* of the front door 7 is constructed of a rectangular hollow section. Accordingly, this configuration of the safety door ensures that when the filling flap is open as shown in FIG. 3, the space above the pressure ram plate 8 is covered in such a way that no waste material can travel upwardly when the pressing shaft is filled, which may lead to problems in the operation. Also, FIG. 4 clearly shows that, when the overall front door 7 is open, there is a safety gap SP having the width of at least a hand between the upper side 8*a* of the pressure ram plate in the highest end position thereof and the door sliding angle 10 of the housing.

The invention is not limited by the embodiments described above which are presented as examples only but can be modified in various ways within the scope of protection defined by the appended patent claims.

I claim:

1. A safety front door for a baling press for producing tied bales of used packaging material, the baling press having a horizontal axis and a vertical axis, the baling press comprising a housing having a bottom portion and a pressure ram vertically movable in the housing, the pressure ram comprising a pressure ram plate having an upper side, further comprising a door sliding angle attached to the housing, the front door comprising a flap having a frame with an upper side, the flap being attached to the housing through a horizontally extending hinge, so that the flap can be swung manually about the hinge into an essentially horizontal position, the flap comprising a forward free flap portion and a flap portion attached to the housing, the flap portions being connected to one another by an additional hinge, wherein, in a final opening position of the flap, the forward free flap portion extends in an approximately vertical direction relative to the bottom portion, wherein the upper side of the frame of the front door and the door sliding angle attached to the housing are located by a predetermined distance above the upper side of the pressure ram plate when the pressure ram is in an uppermost end position thereof, wherein a space defined above the pressure ram plate is enclosed by the frame of the front door when the front door is in a closed position thereof.

2. The safety front door according to claim 1, wherein the door frame is of a rectangular hollow section.

* * * * *